United States Patent [19]

Rabinow

[11] Patent Number: 4,796,448

[45] Date of Patent: Jan. 10, 1989

[54] LOCK WITH REFERENCE PLATE

[76] Inventor: Jacob Rabinow, 6920 Selkirk Dr., Bethesda, Md. 20817

[21] Appl. No.: 140,904

[22] Filed: Jan. 4, 1988

Related U.S. Application Data

[63] Continuation-in-part of Ser. No. 921,437, Oct. 22, 1986, abandoned.

[51] Int. Cl.[4] ..... E05B 29/02

[52] U.S. Cl. ..... 70/495; 70/419

[58] Field of Search ..... 70/351–352, 70/349–350, 355, 362, 364 A, 364 R, 365, 366, 376–378, 382, 384, 385, 419, 302, 303 R, 303 A

[56] References Cited

U.S. PATENT DOCUMENTS

| | | | |
|---|---|---|---|
| 3,167,944 | 2/1965 | Pickering . | |
| 3,505,842 | 4/1970 | Taylor | 70/365 |
| 3,555,858 | 1/1971 | Owen et al. . | |
| 3,837,196 | 9/1974 | Gartner et al. . | |
| 3,868,196 | 2/1975 | Lown . | |
| 4,114,410 | 9/1978 | Astier | 70/339 |
| 4,163,376 | 8/1979 | Miller | 70/303 A |
| 4,193,277 | 3/1980 | Lo | 70/358 |
| 4,485,648 | 12/1984 | Rabinow | 70/364 R |
| 4,599,877 | 7/1986 | Rabinow | 70/366 |
| 4,627,252 | 12/1986 | Lo | 70/351 |

*Primary Examiner*—Robert L. Wolfe

*Attorney, Agent, or Firm*—Hall, Myers & Rose

[57] ABSTRACT

This invention relates to a lock where a key or a dial sets a set of elements into a unique configuration. The elements do not contain any information relating to the key. They are preferably all alike and, preferably, each of them terminates in a pointed end. Co-operating with these elements, the lock contains a perforated or indented reference plate where the perforation, or indentations, are so located that when the proper key or combination is fed into the lock the ends of the elements can all enter the plate and the lock can be opened. The lock has the additional feature that when it is desired to change the key, or the combination, only the plate needs to be changed. The key-set or the dial-set elements remain the same.

14 Claims, 3 Drawing Sheets

FIG. 7
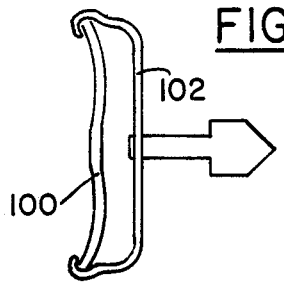
FIG. 8
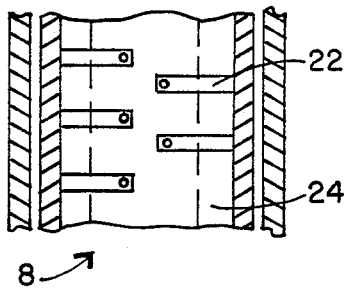
FIG. 9
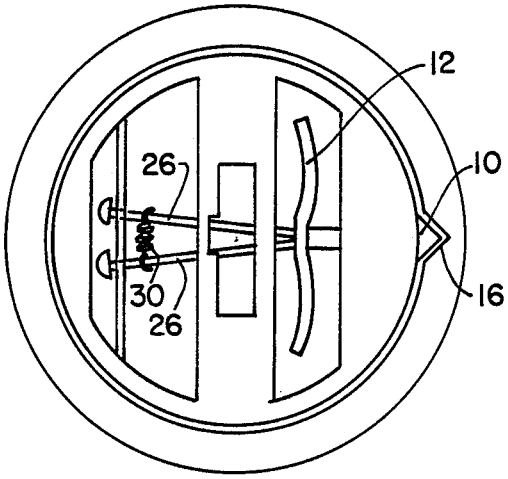
FIG. 10
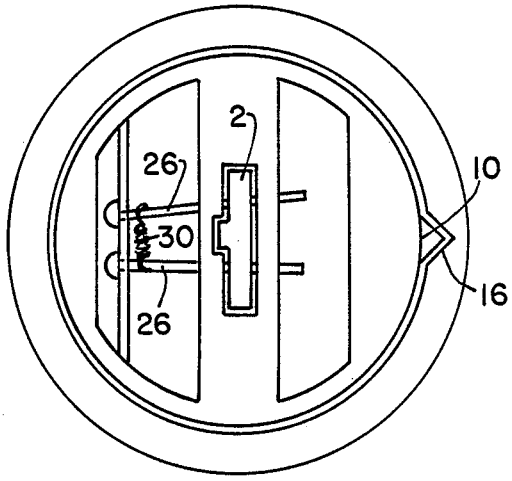
FIG. 11
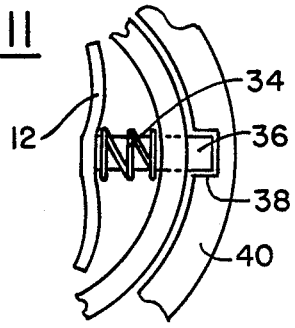
FIG. 12
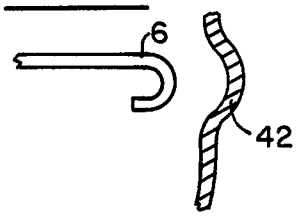
FIG. 13
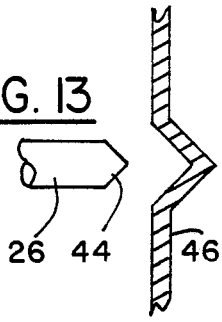
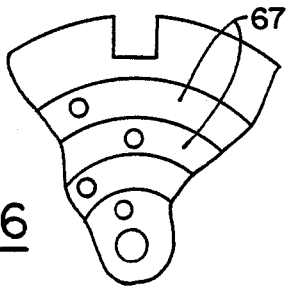
FIG. 16
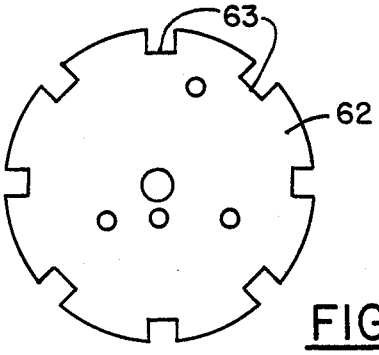
FIG. 15

FIG. 14
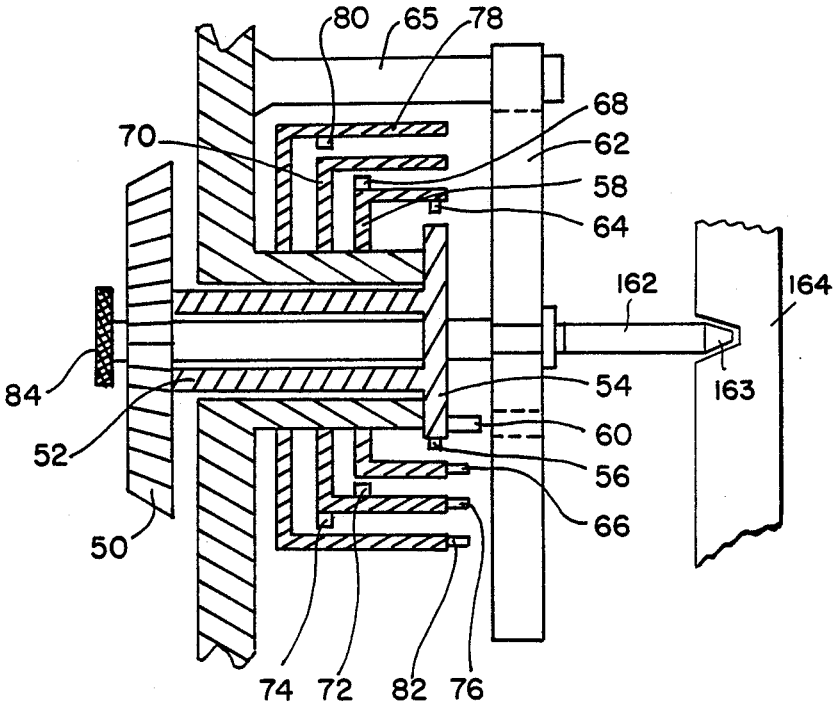
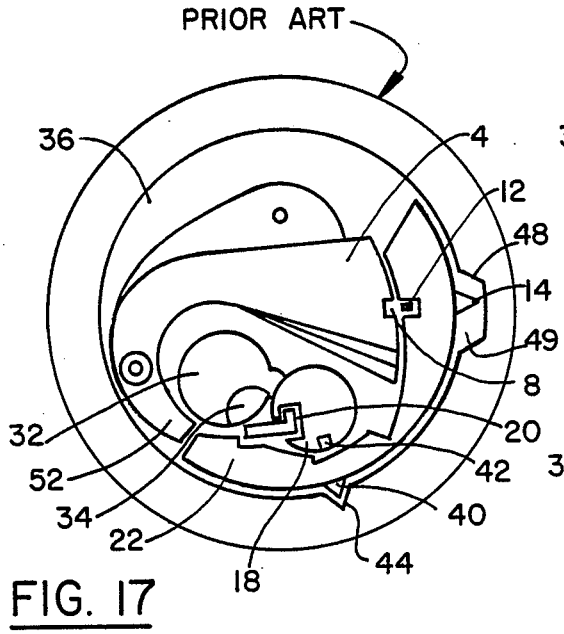
FIG. 17
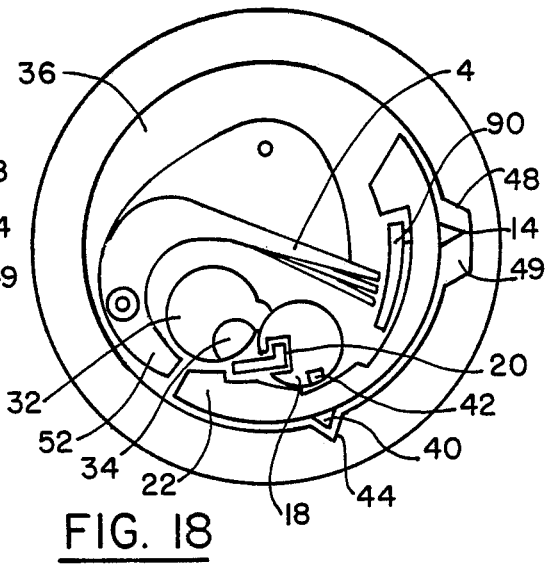
FIG. 18

LOCK WITH REFERENCE PLATE

This is a continuation-in-part of application Ser. No. 921,437, filed Oct. 22, 1986, and now abandoned.

BACKGROUND OF THE INVENTION

This invention is based on the attempt to fulfill several requirements for a new lock.

First there is a need for an easily changed internal combination of the lock so that the key can be easily changed. This is particularly needed in hotels or with safe-deposit boxes in banks. In certain critical uses of dial operated safes it is often required that the combination be changed at regular intervals.

Secondly there is always a need to make the lock as simple and as inexpensive as possible.

Thirdly there is a need to make the lock as small as possible, without sacrificing ruggedness and ease of manufacture.

Fourthly the lock should be difficult to pick, that is, to be opened without the use of the correct key and without inflicting any damage to the lock.

Fifth the lock should be such that a very large number of different keys, or dial combinations, should be available.

I believe that the various embodiments of my invention meet the above criteria.

I am aware that the prior art shows locks where a change of key is readily accomplished. Such locks may contain an easily replaceable key cylinder. In other designs, the keysettable elements are themselves modified. See, for example U.S. Pat. No. 3,837,196. In some cases, the key itself can be changed by cooperation with the lock. An example of this is U.S. Pat. No. 3,868,196.

Two patents that are much closer to the subject of my invention are U.S. Pat. Nos. 3,555,858 and 3,167,944.

In U.S. Pat. No. 3,167,944 to Pickering, there are shown two "permutation strips" that have fins 36 that, in turn, are images of the key (see FIG. 7). The two strips are complimentary to each other so that a plurality of "slides" will be shifted by the key so that they will be properly positioned between the two strips and the lock will then be opened. It should be noted that the two opposite edges of the key have to be complimentary to each other, and both are complimentary to the two permutations strips. This is a limitation on the number of different keys that can be used with this lock. Also the need for two closely related exchangeable strips adds to the cost and complexity of the device.

U.S. Pat. No. 3,555,858 shows another device where a "slug" component complimentary to the desired key is designed to permit the change of a key by changing this component. Each "Slotted Plate" 66 is pulled by a spring 112 to the right as viewed in FIG. 6 or FIG. 4. Thus, when the key is pressed against the slotted plates 66, they will attain their correct position for the lock to open. Because the sliding "slotted plates" 66 have many notches, many different keys can be accomodated. In this lock the number of different keys that can be made for the lock depends on the number and position of the notches, or slots, in the sliding plates 66.

The art of changeable locks is quite extensive. The two locks mentioned above are merely examples. In the case of conventional dial-operated combination locks, a series of discs are rotated. Each disc is usually provided with a notch so that when all of the discs are properly set, the notches are aligned, and a "fence" is able to enter the aligned notches. This permits the lock to open. In changeable combination locks, the discs are usually made of two concentric components. The outer component carries the usual notch. The other component, usually of smaller diameter, carries the interlocking or driving pins that co-operate with another disc. The two components normally rotate as one unit. When it is desired to change the combination, the two components are released from each other and the relationship between the notch and the driving pins can be altered. After this the two parts are locked to each other again, and rotate as one unit.

My invention can make use of a particular form of a combination lock where the usual discs are replaced by a set of concentric rings. The rings are interlocked exactly in the same manner as discs in a more conventional lock. Such a lock is on display in the lock museum of the Sargent and Greenleaf Company in Kentukee. I shall explain this lock in greater detail in one embodiment of any invention.

FIG. 7 shows a possible design of the lock where the Reference Plate is changeable.

FIG. 8 shows a section of lock of FIG. 2 taken along line 8—8.

FIG. 9 shows a variation of the lock where the keysettable elements are separate pins.

FIG. 10 shows the elements of FIG. 9 as operated upon by a key.

FIG. 11 shows a variation of the lock of FIG. 2 where the plate operating spring is acting in a direction opposite to the plate spring of FIG. 2.

FIG. 12 shows a detail of an optional spring-end and a section of the corresponding reference plate.

FIG. 13 shows a detail of a pin-end and a section of the corresponding reference plate.

FIG. 14 shows the section of combination lock using several concentric rings.

FIG. 15 shows the view of the plate of FIG. 14.

FIG. 16 shows a section of the plate of FIG. 15 where the plate is divided into several concentric mutually adjustable rings.

FIG. 17 shows a copy of FIG. 8 of my U.S. Pat. No. 4,599,877.

FIG. 18 shows a modification of the design of my U.S. Pat. No. 4,599,871 as applied to this invention.

Figure 1:
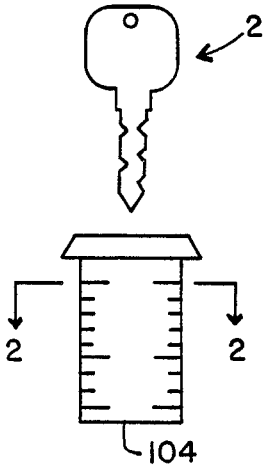
FIG. 1 shows a side view of a simple cylinder lock and a key for same.
Figure 2:
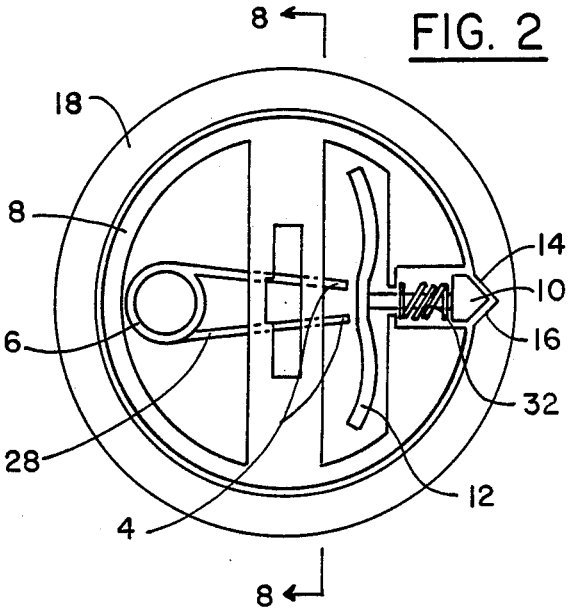
FIG. 2 shows a simplified view taken roughly along lines 2—2 in FIG. 1. The key is not in the lock.
Figure 4:
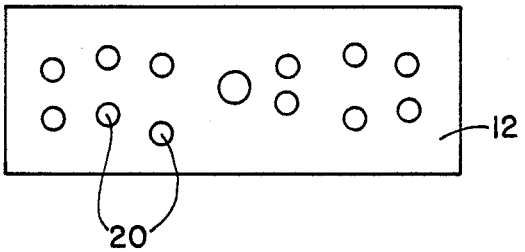
FIG. 4 shows a view of the Reference Plate.
Figure 5:
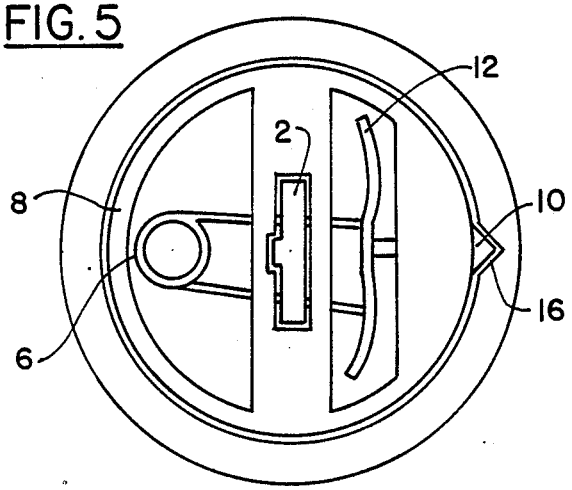
FIG. 5 shows the section of FIG. 2 with the key in the lock.
Figure 6:
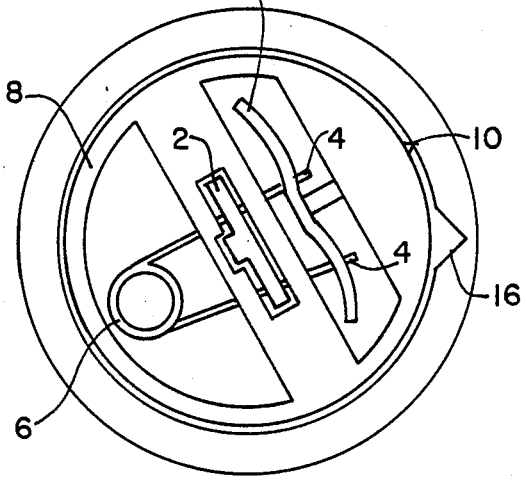
FIG. 6 shows the lock after having been turned thru a small angle.

FIGS. 1 and 2 illustrate the basic features of this invention. The conventional key 2 controls the positions of the ends 4 of springs 6. These spring-ends 4 act as the settable elements of this embodiment. After the key 2 has been fully inserted into the lock and is started to turn the inner cylinder 8 of the lock, the pin 10 connected to the plate 12 is cammed (to the left as seen in FIG. 2) by the sides 14 of the notch 16 in the outer case 18. This camming action moves the plate 12 into engagement with the spring-ends 4, and if the plate 12 is perforated with holes 20 in the correct places (see FIG. 4), it moves to the left, as seen in FIG. 2, and permits the cylinder 8 to turn as in FIG. 6. If an incorrect key is used, or if an attempt is made to pick the lock, the holes 20 in the plate 12 will not match the spring-ends 4 and the lock will not turn. Because the ends 4 of the springs 6 move in arcs, the plate 12 can be suitably curved as shown.

Figure 3A:
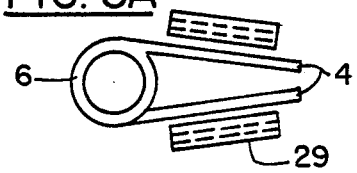
FIGS. 3A–3C show one spring element of the lock of FIG. 2.
Figure 3B:
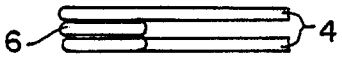
Figure 3C:
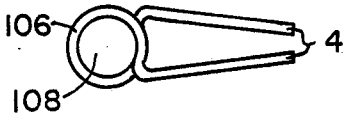

To clarify the construction of the lock of FIG. 2, please consult FIGS. 3A and 3B and 3C that show the simple design of the spring 6. Because such a lock may use five or six springs 6, the plate 12 may look as in FIG. 4.

Because the spring-ends 4 have to be controlled in their motions as they are acted upon by the key 2, I show a possible construction detail of the lock body 8. The spring-ends are located in slots 22 (FIG. 8) formed in the central structure 24 of the cylinder 8 so that they can move together and apart as seen in FIG. 2, but cannot move parallel to the direction of motion of the key 2 as it is inserted or removed from the lock.

In FIG. 9 I show a slightly mroe complex design of the same lock, except that here I use separate pins 26 in place of the spring arms 28 in the previous Figures.

Each pair of pins 26 is held in their normal positions by a spring 30. The key 2, of course, acts against a multiplicity of these springs.

In the embodiments described so far I show a spring 32 acting on the plate-pin 10 to push it to the right as seen in FIG. 2 and thus keep the plate 12 out of contact with the settable elements 28 until the inner cylinder 8 is turned by a key.

In FIG. 11 I show an inversion of the spring system that acts upon the plate 12. Here the spring 34 pushes the plate 12 toward the left as seen in the FIG. 11. The pin 36 is not designed for cam action, nor is the notch 38 in the outer case 40. The plate 12 will now be always in contact with spring-ends 4 or pins 26, but because the spring 34 is very light as compared to the forces of springs 6 or 30, the plate 12 will not prevent these key-settable elements from returning to the normal rest positions as shown in FIG. 2. To help in this action the ends of the springs 6 can be bent into the shape shown in FIG. 12, together with a section of the corresponding plate 42.

When separate pins 26 are used as in FIG. 9, the ends 44 can be formed as small cones and the plate 46 can be either perforated or, preferably, be indented as shown in FIG. 13. This, again, is a desirable design where the plate 46 is constantly urged to the left as viewed in FIG. 11.

As mentioned, earlier, there is a dial-set combination lock that is particularly suitable for use with my invention.

In FIG. 14 I show a schematic design of a dial-set combination lock as a section taken at right angles to the face of a safe. Dial 50 turns a hollow shaft 52 that is rigidly attached to a disc 54. This disc 54 has a radial pin 56 that is employed to turn the first ring 58, and an axial pin 60 to cooperate with plate 62. The first ring 58 has a radial pin 64 to cooperate with pin 56 of the disc 54, a pin 66 to cooperate with the plate 62, and a third pin 68 to cooperate with the second ring 70.

The second ring 70 is also provided with three pins, 72, 74, and 76. Pin 74 is used to turn the third ring 78, while pin 76 cooperates with plate 62, and pin 72 to cooperate with pin 68 of the first ring 58. Ring 78 is built in the same manner but it needs only two pins 82 and 80.

The plate 62 is arranged so that it can move toward or away from the disc 54 and rings 58, 70 and 78 when acted upon by a pull-knob 84, or by an suitable mechanism that can be activated by a separate handle when the lock is to be opened.

In FIG. 15 I show how the plate 62 may look. The outside notches 63 keep the plate 62 from turning during the operation of the lock. A change of the combination can be made by simply removing the plate 62 from the lock and rotating it so that a different notch 63 can engage post 65 rigidly mounted on the door of the safe.

A better method of changing the combination, and a method well known in the art of combination locks, is to make the plate 62 of several concentric sections 67 as shown in FIG. 16. The sections are held together by any suitable means and in normal operation do not move relative to each other, because of considerable built-in friction or by means of releasable clutch mechanisms. I do not claim this as part of my invention. Such adjustable discs are common to most good combination locks, where a plurality of discs are used when setting the combination.

In order that the plate 62 will not be movable while the knob 50 is being turned, pin 60 of the disc 54 is made longer than the other pins 66, 76 and 82 so that the dial 50 must always be set at a predetermined position before the plate 62 can be moved. This type of operation is common to many conventional combination locks.

When the correct combination has been dialed, handle 84 may be moved to the left as the various settable elements, such as 60, enter their complementary holes in plate 62 and withdrawing pin 162 from notch 163 whereby number 164 may be moved vertically to open the lock.

In FIGS. 12 and 18 I show how my present invention can be applied to the much more sophisticated lock shown in U.S. Pat. No. 4,599,877 issued to me on July 15, 1986.

First please consider FIG. 8 of that Patent reproduced here as FIG. 17. It will be noted that in this lock the sectors 4 had to be individually and differently notched at 8 so that the fence 12 could enter the notches 8 for the lock to open.

In applying the present invention to that lock, I modify the sectors 4 so that they are all alike, and each comes to a small point as shown in FIG. 18. The fence 12 of FIG. 8 of the old Patent is now replaced by a plate 90, still acted upon by a pin 14. It should be noted that the modified lock is simpler and can be made smaller.

it should also be noted that changing the key becomes much easier as there is only one member, the plate 90, that needs to changed in place of the half dozen or so sectors 4 of FIG. 17 (old FIG. 8).

This brings me to the discussion of one of the great advantages of this invention. The plate 12 of FIG. 2 can be modified as shown in FIG. 7. Here the plate 100 is made as a separate element held in position by the permanent plate holder 102. The plate 100 can be designed to be easily slideable out of the holder 102 when reached from the bottom end 104 of the lock of FIG. 1. Suitable snap detents, pushed out of the plate 100, and corresponding depression in the holder 102 can keep the plate 100 in place during normal operation of the lock.

The embodiments described in the above specification are given as examples only. It is obvious that many changes can be made without departing from the basic concepts.

For example, the springs of FIG. 3 need not be made of round wire. Flat spring wire can be used to make the spring softer in opening and closing, while the arms of the spring can be very stiff.

it may be noted that as the key spreads the arms of the spring 6 as in FIG. 2, the coil of the spring opens somewhat. If this is undesirable in some cases, the arms of the spring 106 can be crossed over as in FIG. 3*c* so that when the key spreads the arms, the spring coil becomes tighter around its supporting post 108. The friction between the key 2 and the spring-arms 28 (FIG. 2) can be reduced while the stiffness of the arms 28 can be increased at the same time by enclosing the arms in two thin cylinders 29 shows in FIG. 3A.

While I show that the settable elements end in rather sharp pointed ends, this is not necessary for my invention to work. For example, the elements of FIG. 18 can end in rectangles. As long as the holes or depression in the reference plate 90 match the ends of the elements, the lock will work correctly.

I claim to have invented:

1. In a lock, locking means comprising first and second members one of which is movable with respect to the other in order to unlock the lock, a movable third member, which when the lock is in a locked mode is in a first position wherein it blocks relative movement of said first and second members, and is movable in a predetermined direction away from said first position to a second position wherein it does not block relative movement of said first and second members, a plurality of elongated settable elements which if set in predetermined positions, respectively, permit said third member to be moved in said predetermined direction, lock opening means for setting said elements in said predetermined positions, respectively, said settable elements comprising elongated elements having free ends for engaging said third member, means for mounting each of said settable elements at a location remote from its free end, each said settable element being movable so that its free end may be set in a selected position, said free ends and said third member comprising means so that if any one of said free ends is not in its selected position such free end will block movement of said third member in said predetermined direction and thus prevent the lock from opening; but when all of said free ends are in their respective selected positions the third member may move in said predetermined direction with a resulting overlap between said third member and each of said free ends whereby the first and second members may have relative movement permitting the lock to open, said third member comprising a plate having holes therein with one such hole for each said free end, each hole being positioned to receive its complementary said free end when said free ends are in said predetermined positions, respectively.

2. In a lock as defined in claim 1, each said free ends being pointed so as to readily find its complementary hole in said plate.

3. In a lock, locking means comprising first and second members one of which is movable with respect to the other in order to unlock the lock, a movable third member, which when the lock is in a locked mode is in a first position wherein it blocks relative movement of said first and second members, and is movable in a second position wherein it does not block relative movement of said first and second members, said movable third member including means having information necessary to open said lock, lock opening means, having means for inserting information into said lock, and a plurality of settable elements which, if set in predetermined positions by said lock opening means, transmit the information of the said lock opening means to said third movable means, so that if the information contained in the said lock opening means matches the information in said third movable member that said third movable member can move to said second position thus permitting the lock to open, said settable elements being elongated and having one end of each element comprising a mounted position and the other end comprising a free end, said lock-opening means comprising a key which engages said elongated settable elements between their mounted positions and their free ends to position said free ends in their respective said predetermined positions, each said elongated settable element comprising flexible material, said key engaging each said flexible elongated settable element to position the free end of such element in its predetermined position.

4. In a lock, locking means comprising first and second members one of which is movable with respect to the other in order to unlock the lock, a movable third member, which when the lock is in a locked mode is in a first position wherein it blocks relative movement of said first and second members, and is movable in a predetermined direction away from said first position to a second position wherein it does not block relative movement of said first and second members, said movable third member including means having information necessary to open said lock, lock opening means, having means for inserting information into said lock, and a plurality of settable elements which, if set in predetermined positions by said lock opening means, transmit the information of the said lock opening means to said third movable means, so that if the information contained in the said lock opening means matches the information in said third movable member that said third movable member can move to said second position thus permitting the lock to open, said settable elements being elongated and having one end of each element comprising a mounted position and the other end comprising a free end, said lock-opening means comprising a key which engages said elongated settable elements between their mounted positions and their free ends to position said free ends in their respective said predetermined positions, each said elongated settable element comprising a pivoted arm which is pivoted at its mounted position, each free end of each said elongated settable element being the free end of one of said pivoted arms, said key engaging said pivoted arms to position said free ends in their respective predetermined positions.

5. In a lock as defined in claim 1, each said free end being pointed so as to readily find its complementary hole in said plate.

6. In a lock, locking means comprising first and second members one of which is movable with respect to the other in order to unlock the lock, a movable third member, which when the lock is in a locked mode is in a first position wherein it blocks relative movement of said first and second members, and is movable in a predetermined direction away from said first position to a second position wherein it does not block relative movement of said first and second members, a plurality of elongated settable elements which if set in predetermined positions, respectively, permit said third member to be moved in said predetermined direction, lock opening means for setting said elements in said predetermined positions, respectively, said settable elements comprising elongated elements having free ends for engaging said third member, said free ends and said third member comprising means so that if any one of said free ends is not in its selected position such free end will block movement of said third member in said predetermined direction and thus prevent the lock from opening; but when all of said free ends are in their respective selected positions the third member may move in said predetermined direction with a resulting overlap between said third member and each of said free ends whereby the first and second members may have relative movement permitting the lock to open.

7. In a lock, locking means comprising first and second members of which one is movable with respect to the other in order to unlock the lock, a movable third member, which when the lock is in a locked mode is in a first position wherein it blocks relative movement of said first and second members, and which is movable in a predetermined direction away from said first position to a second position wherein it does not block relative movement of said first and second members, said movable third member including means having information necessary to open said lock, lock opening means, having means for inserting information into said lock, and a plurality of settable elements comprising means which are positioned by said lock opening means and which if set in predetermined positions respectively by said lock opening means, transmit the information of the said lock opening means to positions adjacent to said third movable member, so that if the information contained in the said lock opening means matches the information in said third movable member said third movable member can move to said second position thus permitting the lock to open, and means for moving said third member in said predetermined direction when the lock is being opened.

8. In a lock as defined in claim 7, said last-named means comprising a spring biasing said movable third member in said predetermined direction.

9. In a lock as defined in claim 7 said last-named means being operated by relative movement of said first and second members for moving said third member in said predetermined direction.

10. In the lock as defined in claim 7, said predetermined direction of movement of said third member being transverse to the directions of movement of said settable elements when they are moved by said lock opening means, each of said settable elements being moved by said lock opening means to its predetermined position in a direction transverse to the direction of its elongation.

11. In a lock as defined in claim 7:

said movable third member being removable from the lock and replaceable with a similar device containing different stored information, whereby the information that must be fed into the lock in order to open the lock may be changed, 12. A lock as defined in claim 7 in which said lock opening means includes a key.

13. A lock as defined in claim 7 in which said lock opening means includes a dial for entering information in said lock opening means by rotating the dial.

14. A lock as defined in claim 7 in which said settable elements comprise a male device and the third member is a female device, said last-named means moving said third member to unlock the lock if the settable elements mate with the third member and to leave the lock in a locked relation if the settable elements do not mate with the third member.

* * * * *